United States Patent [19]

Terasawa

[11] Patent Number: 4,999,643

[45] Date of Patent: Mar. 12, 1991

[54] DISCHARGE RECOVERY DEVICE AND APPARATUS HAVING SUCTION MEANS AND VENT MEANS COMMUNICATING WITH CAPPING MEANS

[75] Inventor: Koji Terasawa, Mitaka, Japan

[73] Assignee: Canon Kabushiki Kaisha, Tokyo, Japan

[21] Appl. No.: 488,447

[22] Filed: Feb. 27, 1990

Related U.S. Application Data

[63] Continuation of Ser. No. 106,969, Oct. 13, 1987, abandoned, which is a continuation of Ser. No. 797,863, Nov. 14, 1985, abandoned.

[30] Foreign Application Priority Data

Nov. 19, 1984 [JP] Japan ..... 59-244052
Nov. 19, 1984 [JP] Japan ..... 59-244053

[51] Int. Cl.[5] ..... B41V 2/165
[52] U.S. Cl. ..... 346/1.1; 346/140 R
[58] Field of Search ..... 346/140, 1.1

[56] References Cited

U.S. PATENT DOCUMENTS

| | | | |
|---|---|---|---|
| 3,346,869 | 10/1967 | Stone | 346/75 |
| 4,095,237 | 6/1978 | Amberntsson | 346/140 R |
| 4,112,435 | 9/1978 | Kattner | 346/140 R |
| 4,119,034 | 10/1978 | Wax | 101/366 |
| 4,223,322 | 9/1980 | Raamsdonk | 346/140 R |
| 4,231,046 | 10/1980 | Aiba | 346/75 |
| 4,272,772 | 6/1981 | Geil | 346/140 R |
| 4,300,145 | 11/1981 | Raamsdonk | 346/140 R |
| 4,306,245 | 12/1981 | Kasugayama | 346/140 R |
| 4,367,479 | 1/1983 | Bower | 346/140 |
| 4,369,454 | 1/1983 | Kyogoku | 346/140 R |
| 4,371,881 | 2/1983 | Bork | 346/140 R |
| 4,376,283 | 3/1983 | Bower | 346/140 |
| 4,383,263 | 5/1983 | Ozawa | 346/140 R |
| 4,394,669 | 7/1983 | Ozawa | 346/140 R |
| 4,401,990 | 8/1983 | Aiba | 346/75 |
| 4,403,233 | 9/1983 | Terasawa | 346/140 R |
| 4,410,900 | 10/1983 | Terasawa | 346/140 |
| 4,432,004 | 2/1984 | Glattli | 346/140 R |
| 4,437,104 | 3/1984 | Hudson | 346/140 R |
| 4,437,105 | 3/1984 | Mrazek | 346/140 R |
| 4,492,969 | 1/1985 | Terasawa | 346/140 R |
| 4,543,589 | 9/1985 | Terasawa | 346/140 |
| 4,543,591 | 9/1985 | Terasawa | 346/140 R |
| 4,556,894 | 12/1985 | Terasawa | 346/140 R |
| 4,558,326 | 12/1985 | Kimura | 346/140 X |
| 4,577,203 | 3/1986 | Kawamura | 346/140 |
| 4,587,535 | 5/1986 | Watanabe | 346/140 R |
| 4,590,494 | 5/1986 | Ichihashi | 346/140 R |
| 4,600,931 | 7/1986 | Terasawa | 346/140 R |
| 4,628,333 | 12/1986 | Terasawa | 346/140 |
| 4,631,556 | 12/1986 | Watanabe | 346/140 R |

FOREIGN PATENT DOCUMENTS

| | | |
|---|---|---|
| 119238 | 9/1979 | Japan . |
| 113464 | 7/1981 | Japan . |
| 0198160 | 11/1984 | Japan . |
| 59-199254 | 12/1984 | Japan . |

*Primary Examiner*—Joseph W. Hartary
*Attorney, Agent, or Firm*—Fitzpatrick, Cella, Harper & Scinto

[57] ABSTRACT

Suction recovery device for use in an ink jet printer provided with an ink jet recording unit for emitting ink to a recording surface of a recording medium and a cap member to face the recording unit at a determined position, comprising a suction unit communicating with the cap member and a vent unit communicating with the cap member at a position different than the position where the suction unit communicates with the cap member for opening and closing the interior of the cap member to the atmosphere.

34 Claims, 5 Drawing Sheets

DISCHARGE RECOVERY DEVICE AND APPARATUS HAVING SUCTION MEANS AND VENT MEANS COMMUNICATING WITH CAPPING MEANS

This application is a continuation of application Ser. No. 07/106,969 filed Oct. 13, 1987, now abandoned, which in turn is a continuation of U.S. application Ser. No. 06/797,863 filed Nov. 14, 1985, now abandoned.

BACKGROUND OF THE INVENTION

1. Field of the Invention

The present invention relates to an ink jet printer and a recovery device for recovering the discharge function of such printer (referred to as a recovery device) and more particularly to a recovery device operable to suck ink from an ink emitting nozzle for removing bubbles and clogging therefrom, and an ink jet printer equipped with such recovery device.

2. Description of the Prior Art

There are already known ink jet printers for recording with one or plural recording nozzle units for liquid emission, mounted on a carriage movable in a determined direction with respect to the recording plane. In such ink jet printers it is already known, when the recording nozzle contains bubbles or is clogged, to remove such bubbles or clogging by placing the carriage at a non-recording position, for example at a home position, and sucking ink from the nozzle with a recovery device.

In such an ink jet printer, the recovery device has been operated by opening or closing an external vent pipe connected to a cap member of the recovery device and activating a pump for sucking ink from the nozzle through a suction pipe, through separate actuations of a lever for controlling said vent pipe and another lever for activating the pump. For this reason there has been required a bulky device with a complicated operating procedure.

Besides, in such an ink jet printer, a reduced pressure created by the pump for sucking ink from the nozzle also induces a reduced pressure in said vent pipe, and the ink which has flowed into the cap member through a flexible ink tank, supply tube and recording nozzle of substantially atmospheric pressure tends to migrate into said vent pipe. If the ink forms plural films in the vent pipe, the ink meniscus in the nozzle is influenced disadvantageously when it is automatically covered by said cap member, thus inducing defective emissions.

SUMMARY OF THE INVENTION

In consideration of the foregoing, an object of the present invention is to provide a recovery device by suction, for use in an ink jet printer, featuring a simpler operation and a compacter structure, and an ink jet printer equipped with such recovery device.

Another object of the present invention is to provide a recovery device by suction, for use in an ink jet printer, capable of providing stable ink emission from the nozzle without the above-mentioned drawback even a in case of automatic capping.

Still another object of the present invention is to provide an ink jet printer, in which a lever for driving a pump for the recovery device is also used for opening and closing an end aperture of an external vent pipe connected to the cap member, so that a simpler operation can be achieved with a reduced number of components requiring a smaller space.

Still another object of the present invention is to provide a recovery device by suction, for use in an ink jet printer provided with ink jet recording means for recording by emitting ink to a recording surface of a recording medium and a cap member opposed to said recording means at a determined position, comprising vent means for opening or closing, to the external atmosphere, an end aperture of an external vent pipe connected at the other end to said cap member.

Still another object of the present invention is to provide an ink jet printer provided with ink jet recording means for recording by emitting ink to a recording surface of a recording medium and a recovery device by suction equipped with a cap member opposed to said recording means at a determined position, comprising vent means for opening or closing, to the external atmosphere, an end aperture of an external vent pipe connected at the other end to said cap member.

Still another object of the present invention is to provide a recovery device by suction, for use in an ink jet printer, in which an external vent pipe, connected at an end to the cap member and opened and closed at the other end by an operating lever, is provided with another intermediate aperture controlled by a solenoid valve to maintain the interior of said pipe at atmospheric pressure even during the suction by pump, whereby stable ink emission from the nozzle can be ensured after automatic capping operation, and to provide an ink jet printer equipped with such recovery device

DETAILED DESCRIPTION OF THE PREFERRED EMBODIMENTS

Now the present invention will be clarified in detail by embodiments thereof shown in the attached drawings.

Figure 1:
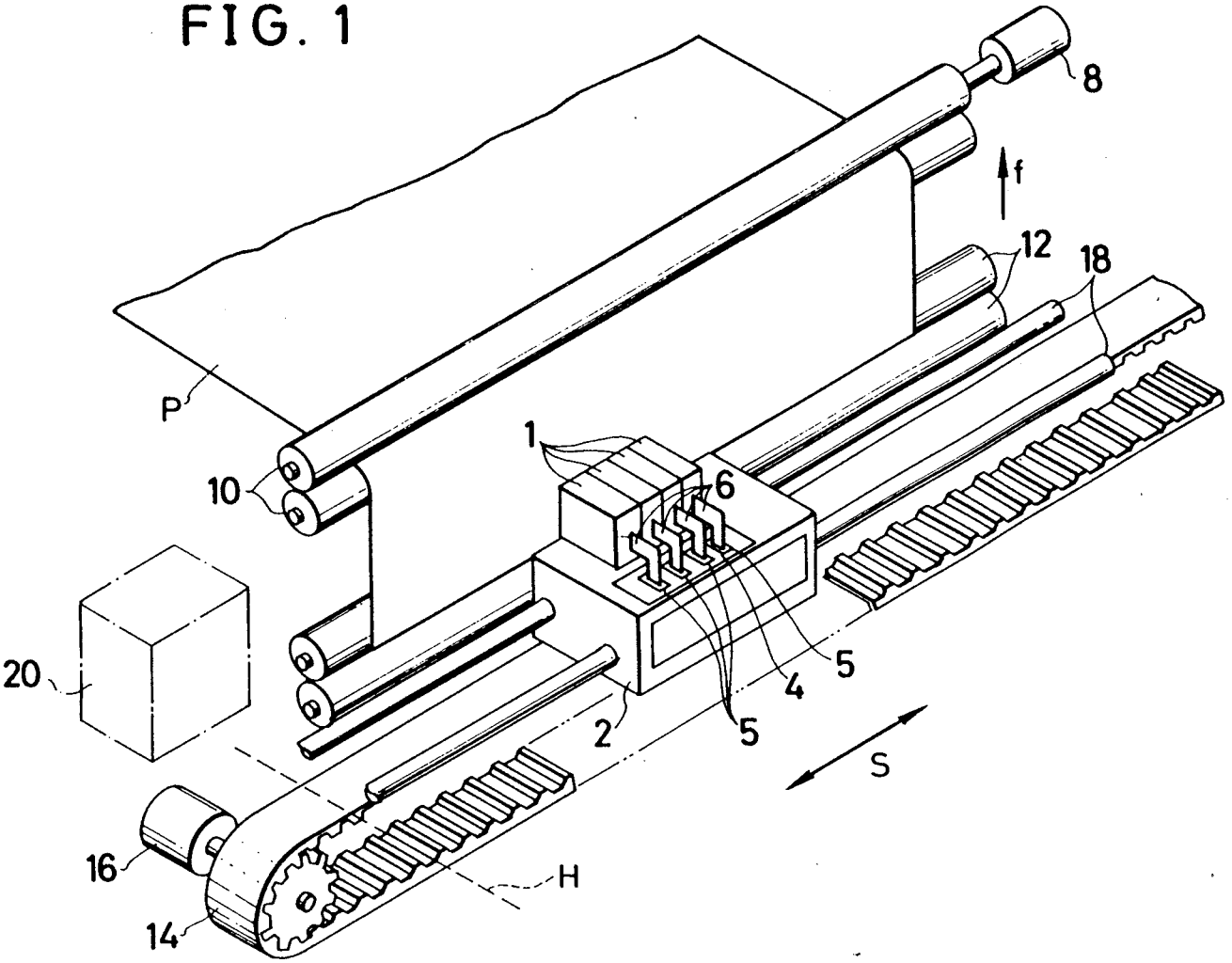
FIG. 1 is a perspective view showing an example of an ink jet printer.

FIG. 1 shows an example of the principal part of an ink jet printer in which the present invention is applicable. An ink jet recording unit 1, mounted on a carriage 2, is provided with an ink reservoir for storing ink supplied from an ink supply source and a recording head with a nozzle for emitting said ink. There are, for example, provided four units 1, corresponding to the number of colors of ink. The carriage 2 can also carry a cartridge tank as an ink source, as will be explained later. A printed circuit board 4 for controlling the ink emission by the ink jet recording unit 1 is connected, through a connector 5, to a flexible cable 6 leading to said unit 1. A sheet feed motor 8 advances a recording sheet P in a direction f by means of rollers 10, 10. Other rollers 12, 12 cooperate with said roller 10, 10 to support the recording sheet P, thus, forming a flat recording surface opposed to said ink jet recording unit 1.

There are also provided a driving belt 14 fixed to the carriage 2, a motor 16 for driving said belt 14 in a direction S, and guide rails 18 for the carriage 2. The carriage 2 is thus displaced by the motor 16 in a direction S along the guide rails 18, thus recording on the recording surface.

A recovery device 20 by suction faces the ink jet recording unit 1 at a home position H and sucks the ink.

Figure 2:
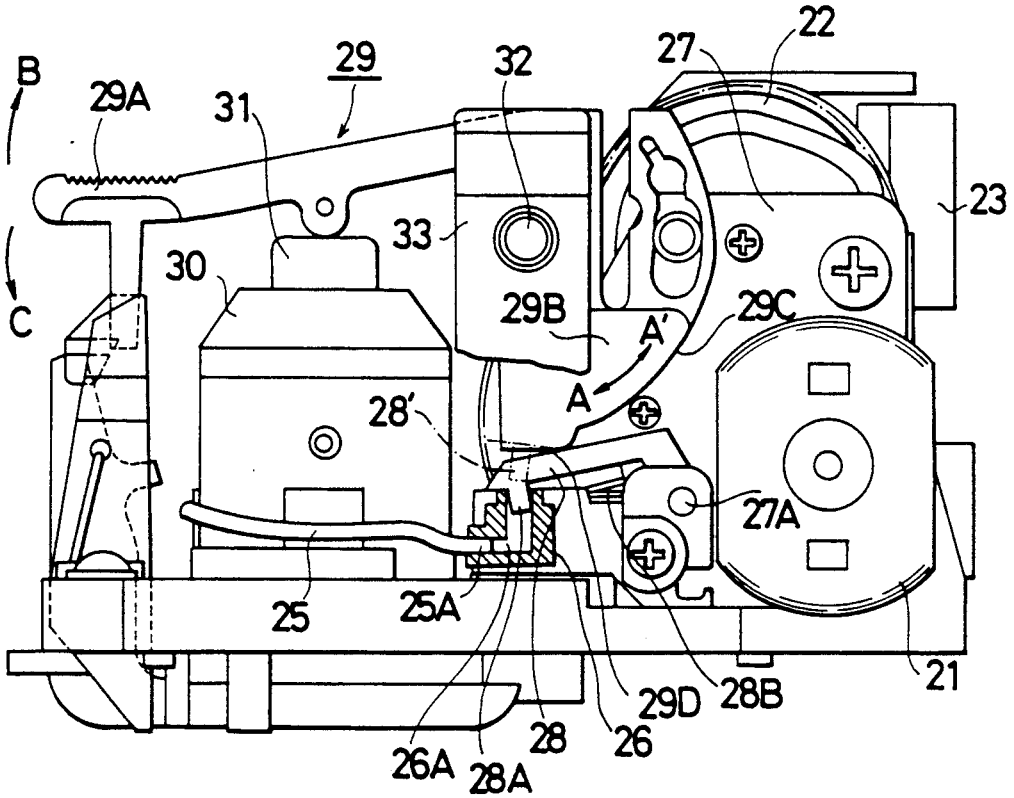
FIGS. 2 and 3 are an elevation view and a plan view showing an embodiment of the recovery device by suction for use in the ink jet printer shown in FIG. 1.
Figure 3:
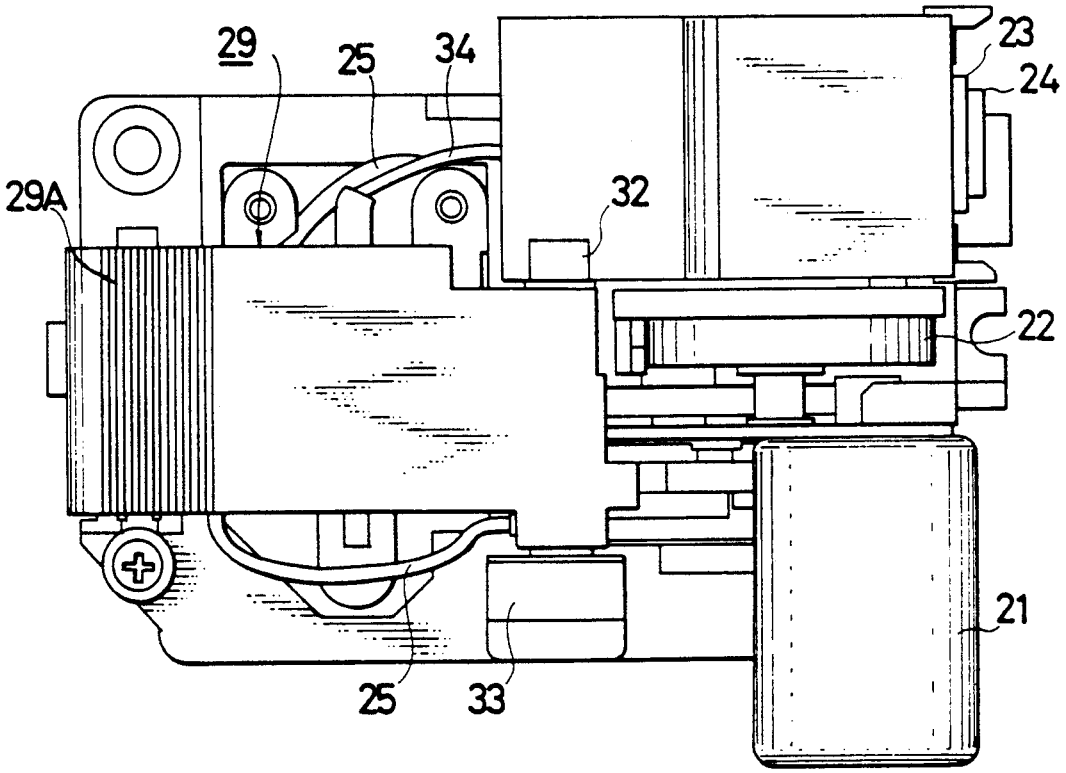

FIGS. 2 and 3 illustrate an embodiment of such recovery device by suction. A motor 21, functioning as the driving source of the recovery device, drives a cam gear 22. A cap member 23, which faces the ink jet recording unit 1 when it is in the home position H, comprises an unrepresented absorbent member, composed for example of an absorbent porous material and to be brought into contact with the nozzle, and a rubber member 24 for ensuring air-tight contact with said nozzle and is forwarded and retracted by said cam gear 22. To said cap member 23 there is connected an end of an external vent pipe 25 for releasing the pressurized air in the cap member 23, generated when the nozzle is closed by said cap member 23, to the atmosphere, and the other end of said vent pipe 25 is open to the external atmosphere. In the present embodiment, the other end aperture 25A of said vent pipe 25 is open to the atmosphere through an aperture 26A of a rubber member 26, and said aperture 26A is rendered open or closed by vent means having a projection 28A of a vent valve 28, rotatably supported by a shaft 27A fixed to a bracket 27. Said vent valve 28 is constantly biased upwards by a spring 28B, so that said aperture 25A of the vent pipe 25 is open to the atmosphere in the absence of an external force to said vent valve 28.

An operating lever 29, rotatably supported by a pin 32 on a support member 33, causes reciprocating motion of a piston 31 of a pump 30 to induce suction. When an operation portion 29A of said lever 29 is moved from the illustrated intermediate position to an upper open position or a lower suction position, a cam face 29B is moved along a line A—A', thereby vertically moving the aforementioned vent valve 28. More particularly, when the operating portion 29A of the lever 29 is moved to an open position B, a smaller radius section 29C of the cam face 29B faces the vent valve 28, which therefore is pushed upwards by the function of the spring 28B to a position represented by a chain line 28', thus opening the aperture 25A of the vent pipe 25. On the other hand, when the operating portion 29A is moved to a suction position C, a larger radius section 29D of the cam face 29B faces the vent valve 28 as in the aforementioned intermediate position, so that the projection 28A of the vent valve 28 is not more pushed into the aperture 26A more than in the illustrated state. At the same time the piston 31 is pushed by the movement of the operating portion 29A, thus causing a suction.

The pump 30 is provided with an unrepresented spring for pushing up the piston 31, and is connected with the cap member 23 through a suction pipe 34. Thus, in response to the actuation of the pump 30, the ink is sucked from the nozzle through said absorbent member and the suction pipe 34 into the pump 30.

As explained above, the foregoing embodiment is constructed in such a manner that an operating lever for activating a pump for the recovery device is also utilized for opening and closing an end aperture of an external vent pipe connected at the other end to the cap member. Thus the pump suction and the opening and closing of said external vent pipe can be controlled by a single operating lever. It is therefore rendered possible to simplify the operating procedure and to miniaturize the device through a reduction in the number of component parts.

Figure 4:
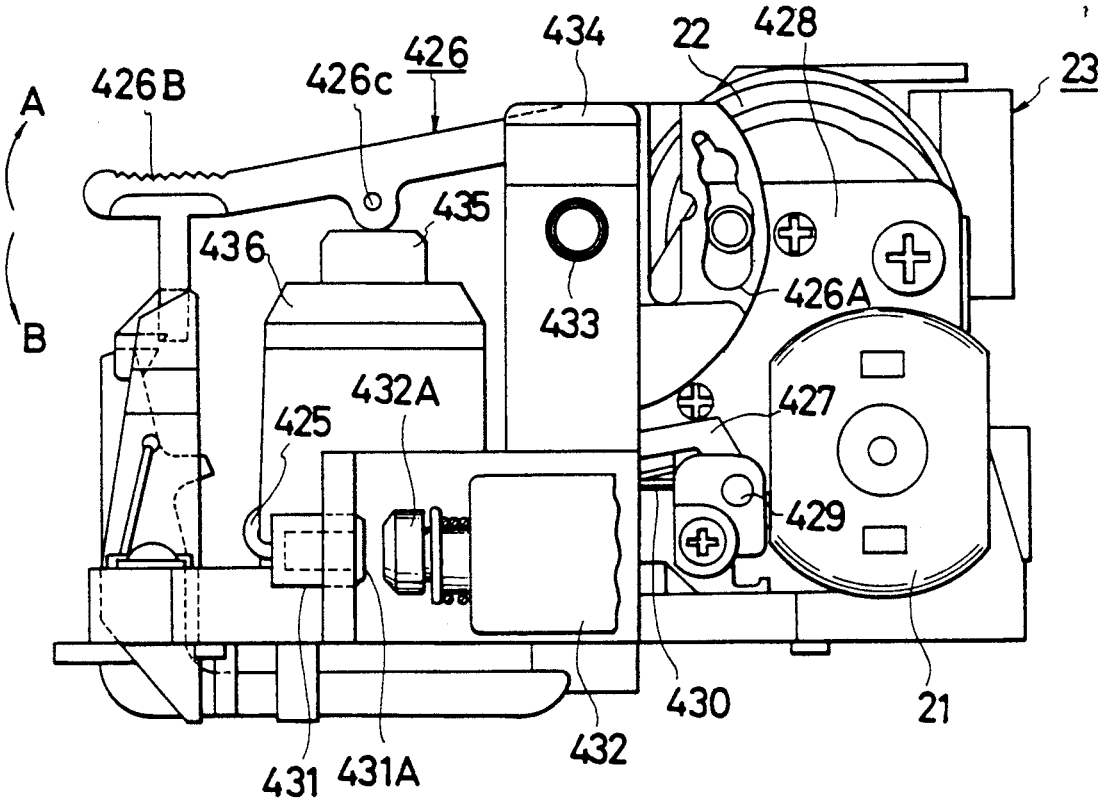
FIGS. 4 and 5 are an elevation view and a plan view showing another embodiment of the recovery device by suction for use in the ink jet printer shown in FIG. 1.

In the following there will be given an explanation on another embodiment of the present invention, shown in FIGS. 4, 5 and 6.

Explanation on the basic structure of the ink jet printer and of the capping mechanism will be omitted since they are fundamentally similar to those in the foregoing embodiment.

In the present embodiment, a cap member 23 is connected to an end of an external vent pipe 425 for releasing the pressurized air, generated in said cap member 23 when the nozzle is closed by said cap member 23, to the external atmosphere, and the other end of said external vent pipe 425 is open to the atmosphere. Said end aperture 425A of the vent pipe 25 (cf. FIG. 6) is opened or closed by vent means having a vent valve 427, in cooperation with a cam face 426A of an operating lever 426. Said vent valve 427 is supported by a shaft 429 fixed to a bracket 428, and is constantly biased upwards by a spring 430. Thus, in the absence of any external force to said vent valve 428, the end aperture 425A of said external vent pipe 425 is open to the external atmosphere.

Figure 5:
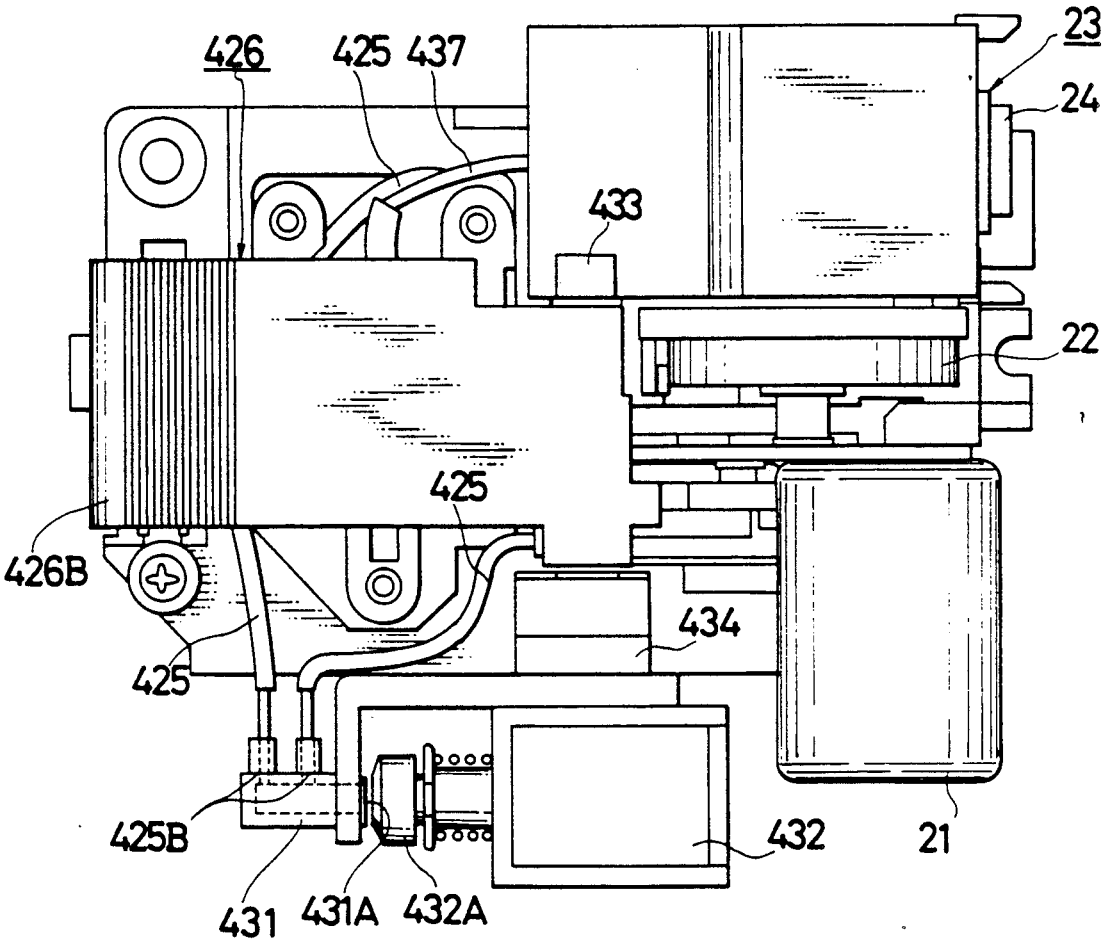
Figure 6:
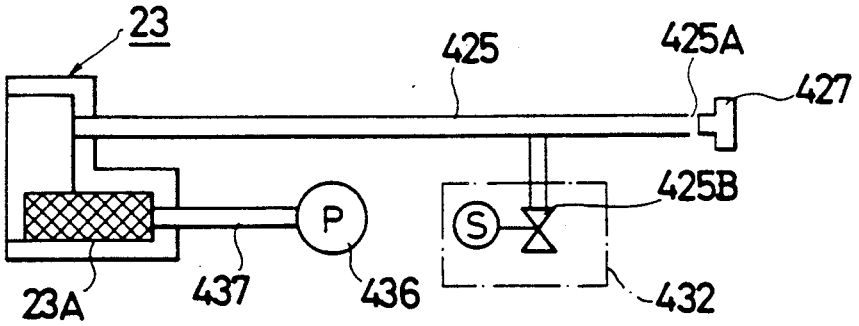
FIG. 6 is a schematic view showing the structure of a recovery system suction.

As shown in FIGS. 5 and 6, said vent pipe 425 is provided with an intermediate aperture 425B connected to an aperture 431A of a valve seat 431, which is opened or closed by a valve 432A of a solenoid valve 432. The aperture 431A is opened to the atmosphere or closed respectively when the solenoid valve 432 is energized or deactivated. Said solenoid valve 432 is energized after a determined time from the activation of the pump, thus opening the aperture 431A of the valve seat to the atmosphere and supplying air into the vent pipe 425. Consequently, even during the suction operation of the pump, the interior of the the vent pipe 425 is always maintained at the atmospheric pressure and the migration of ink into said pipe can be prevented. It is therefore rendered possible to securely prevent the defective ink emission even in the use of automatic capping.

Said operating lever 426 is rotatably supported by a pin 433 on a support member 434. When an operating portion 426B of said lever 426 is moved from the state illustrated in FIG. 4 to a direction A, the end aperture 425A of said vent pipe 425 is rendered open to the atmosphere. On the other hand, when said operating portion 426B is moved to a direction B, a projection 426C thereof pushes a piston 435 to cause suction operation of the pump. The pump 436 is provided with an unrepresented spring for pushing up the piston 435, and is connected to the cap member 23 through a suction 437. Consequently, in response to the operation of the pump 436, ink is sucked from the nozzle through the absorbent member 23A and suction pipe 437 into the pump 436 (cf. FIG. 6).

As explained above, the foregoing embodiment is constructed in such a manner that an external vent pipe, connected at an end to the cap member and closed and opened at the other end by an operating lever, is provided with an intermediate aperture which is opened and closed by a solenoid valve, so that the interior of said vent pipe can always be maintained at the atmospheric pressure, and it is rendered possible to stabilize the ink emission from the nozzle even in an automatic capping operation.

What I claim is:

1. A discharge recovery device for an ink jet recording apparatus, said ink jet recording apparatus having recording means for discharging ink onto a recording medium and capping means having an interior facing said recording means at a predetermined position, said recover device comprising:

suction means communicated at a predetermined position with the interior of said capping means for sucking ink from a discharge port of said recording means through said capping means; and vent means for opening or closing the interior of said capping means to the atmosphere, said vent means having a vent tube member communicating with the interior of said capping means at a different position than the position where said suction means communicates with the interior of said capping means, wherein said vent means communicates the interior of said capping means with the atmosphere a predetermined time period after the initiation of suction by said suction means.

2. A discharge recovery device according to claim 1, wherein said vent means includes a solenoid. Communicates the interior of said capping means with the atmosphere a predetermined time period after the driving of said suction means.

3. A discharge recovery device according to claim 1, further including a lever for driving said suction means and wherein said vent means stops the communication between the interior of said capping means and the atmosphere when said suction means is driven in association with said lever.

4. A discharge recovery device according to claim 1, further including a lever for driving said suction means and wherein said vent means includes a valve for stopping the communication between the interior of said capping means and the atmosphere when said suction means is driven in association with said lever and a solenoid valve for communicating the interior of said capping means with the atmosphere.

5. A discharge recovery device according to claim 1, wherein an ink absorbing member is provided in said capping means.

6. A discharge recovery device according to claim 5, wherein said ink absorbing member is provided at a section of said capping means communicating with said suction means.

7. A discharge recovery device according to claim 1, wherein said vent means includes an electromagnetic valve.

8. An ink jet recording apparatus comprising:

a recording head having a discharge port for discharging ink therethrough;

conveying means for conveying a recording sheet;

capping means having an interior facing said recording head at a predetermined position;

suction means communicated at a predetermined position with the interior of said capping means for sucking ink from said discharge port of said recording means through said capping means; and vent means for opening or closing the interior of said capping means to the atmosphere, said vent means having a vent tube communicating with the interior of said capping means at a different position than the position where said suction means communicates with the interior of said capping means, wherein said vent means communicates the interior of said capping means with the atmosphere a predetermined time period after the initiation of suction by said suction means.

9. An ink jet recording apparatus according to claim 8, wherein said vent means includes a solenoid. Communicates the interior of said capping means with the atmosphere a predetermined time period after the driving of said suction means.

10. An ink jet recording apparatus according to claim 8, further including a lever for driving said suction means and wherein said vent means stops the communication between the interior of said capping means and the atmosphere when said suction means is driven in association with said lever.

11. An ink jet recording apparatus according to claim 8, further including a lever for driving said suction means and wherein said vent means includes a valve for stopping the communication between the interior of said capping means and the atmosphere when said suction means is driven in association with said lever and a solenoid valve for communicating the interior of said capping means with the atmosphere.

12. An ink jet recording apparatus according to claim 8, wherein an ink absorbing member is provided in said capping means.

13. An ink jet recording apparatus according to claim 12, wherein said ink absorbing member is provided at a section of said capping means communicating with said suction means.

14. An ink jet recording apparatus according to claim 8, wherein said vent means includes an electromagnetic valve.

15. An ink jet recording apparatus according to claim 8, wherein a plurality of said recording heads are provided in accordance with ink colors.

16. An ink jet recording apparatus according to claim 8, wherein said recording head comprises four recording head units.

17. A discharge recovery device for an ink jet recording apparatus, said ink jet recording apparatus having recording means for discharging ink onto a recording medium and capping means having an interior facing said recording means at a predetermined position, said device comprising:

suction means communicated with the interior of said capping means for sucking ink from a discharge port of said recording means through said capping means;

a vent tube communicating with said cap;

first vent means associated with said vent tube for opening or closing the interior of said capping means to the atmosphere, said first vent means being operatively associated with said suction means; and second vent means associated with said vent tube for opening or closing the interior of said capping means to the atmosphere, said second vent means being driven by a source different from that of said suction means, wherein said second vent means communicates the interior of said capping means with the atmosphere a predetermined time period after the initiation of suction by said suction means.

18. A discharge recovery device according to claim 17, further including a lever for driving said suction means and wherein said first vent means performs opening or closing in association with said lever.

19. A discharge recovery device according to claim 17, wherein said first vent means is biased by a spring to an open condition.

20. A discharge recovery device according to claim 17, wherein said second vent means includes a solenoid and said capping means is communicated with the atmosphere by driving said solenoid.

21. A discharge recovery device according to claim 17, wherein an ink absorbing member is provided in said capping means.

22. A discharge recovery device according to claim 8, wherein said second vent means is provided at an intermediate position between said first vent means and said capping means.

23. A discharge recovery device for an ink jet recording apparatus, said device comprising:

a cap having an interior for covering a discharge port for discharging ink therethrough;

suction means communicated with said cap for sucking ink from said discharge port through said cap;

a vent tube communicating with said cap;

first vent means associated with said vent tube for opening or closing the interior of said cap to the atmosphere wherein said first vent means is closed when said suction means is driven for stopping the communication between the interior of said cap and the atmosphere; and second vent means associated with said vent tube for opening or closing the interior of said cap to the atmosphere, wherein said second vent means communicates the interior of said cap with the atmosphere after a predetermined time period.

24. An ink jet recording apparatus comprising:

a recording head having a discharge port for discharging ink therethrough;

conveying means for conveying a recording sheet;

capping means having an interior facing said recording head at a predetermined position;

suction means communicated with the interior of said capping means for sucking ink from said discharge port through said capping means;

a vent tube communicating with said capping means;

first vent means communicating with said vent tube for opening or closing the interior of said capping means to the atmosphere, said first vent means being operatively associated with said suction means; and second vent means associated with said vent tube for opening or closing the interior of said capping means to the atmosphere, said second vent means being driven by a drive source different from that of said suction means, wherein said second vent means communicates the interior of said capping means with the atmosphere a predetermined time period after the initiation of suction by said suction means.

25. An ink jet recording apparatus according to claim 24, wherein said first vent means is based by a spring to an open condition.

26. An ink jet recording apparatus according to claim 24, wherein said second vent means includes a solenoid and said capping means is communicated by driving said solenoid with the atmosphere.

27. An ink jet recording apparatus according to claim 24, wherein an ink absorbing member is provided in said capping means.

28. An ink jet recording apparatus according to claim 24, wherein said second vent means is provided at an intermediate position between said first vent means and said capping means.

29. An ink jet recording apparatus according to claim 24, wherein a plurality of said recording heads are provided in accordance with ink colors.

30. An ink jet recording apparatus according to claim 24, wherein said recording head comprises four recording head units.

31. An ink jet recording apparatus comprising:

a recording head having a discharge port for discharging ink therethrough;

a cap having an interior for covering said discharge port at a predetermined position;

suction means communicated with said cap for sucking ink from said discharge port through said cap;

a vent tube communicating with said cap;

first vent means associated with said vent tube for opening or closing the interior of said cap to the atmosphere wherein said first vent means is closed when said suction means is driven for stopping the communication between the interior of said cap and the atmosphere; and second vent means associated with said vent tube for opening or closing the interior of said cap to the atmosphere wherein said second vent means communicates the interior of said cap with the atmosphere after a predetermined time period.

32. An ink jet recording apparatus according to claim 31, further including a lever for driving said suction means and wherein said first vent means performs opening or closing in association with said lever for driving said suction means.

33. A method for recovering discharge in an ink jet recording apparatus by utilizing a discharge recovery device comprising capping means having an interior for covering a discharge port for discharging ink therethrough, suction means communicating with the interior of said capping means and vent means for opening or closing the interior of said capping means to the atmosphere, said method comprising the steps of:

covering said discharge port by said capping means;

sucking ink through said capping means from said discharge port by driving said suction means and stopping communication between said capping means and the atmosphere by said vent means; and communicating the interior of said capping means with the atmosphere using said vent means a predetermined time period after the initiation of suction by said suction means.

34. An ink jet printer comprising:

a recording head for ejecting ink through a nozzle onto a recording medium;

a conveying roller for conveying a recording sheet;

a cap having an interior facing said recording head at a predetermined position;

a suction pump communicated at a predetermined position with the interior of said cap for sucking ink from said nozzle through said cap; and a vent valve for opening or closing the interior of said cap to the atmosphere, said vent valve having a vent tube communicating with the interior of said cap at a different position than the position where said suction pump communicates with the interior of said cap, wherein said vent valve communicates the interior of said cap with the atmosphere a predetermined time period after the initiation of suction by said suction pump.

* * * * *

UNITED STATES PATENT AND TRADEMARK OFFICE

CERTIFICATE OF CORRECTION

PATENT NO. : 4,999,643

DATED : March 12, 1991

INVENTOR(S) : KOJI TERASAWA

It is certified that error appears in the above-identified patent and that said Letters Patent is hereby corrected as shown below:

COLUMN 1

Line 63, "a in" should read --in a--.

COLUMN 2

Line 66, "roller 10, 10" should read --rollers 10, 10--.
Line 67, "thus," should read --thus--.

COLUMN 3

Line 52, "more" should be deleted.

COLUMN 4

Line 19, "vent pipe 25" should read --vent pipe 425--.
Line 25, "valve 428," should read --valve 427,--.
Line 38, "the the" should read --the--.
Line 53, "suction 437." should read --suction pipe 437.--.

COLUMN 5

Line 6, "recover" should read --recovery--.
Line 22, "Communi-" should be deleted.
Lines 23-25 should be deleted.

COLUMN 6

Line 4, "Commu-" should be deleted.
Lines 5-7 should be deleted.
Line 48, "said cap;" should read --said capping means;--.

--

UNITED STATES PATENT AND TRADEMARK OFFICE

CERTIFICATE OF CORRECTION

PATENT NO. : 4,999,643

DATED : March 12, 1991

INVENTOR(S) : KOJI TERASAWA

It is certified that error appears in the above-identified patent and that said Letters Patent is hereby corrected as shown below:

COLUMN 7

Line 9, "8," should read --17,--.
Line 57, "based" should read --biased--.
Line 62, "by driving" should be deleted.
Line 63, "said solenoid with the atmosphere." should read --with the atmosphere by driving said solenoid.--.

COLUMN 8

Line 29, "31," should read --24,--.

Signed and Sealed this

Tenth Day of November, 1992

*Attest:*

*Attesting Officer*

DOUGLAS B. COMER

*Acting Commissioner of Patents and Trademarks*